US006091210A

United States Patent [19]

Cavolina

[11] Patent Number: 6,091,210

[45] Date of Patent: Jul. 18, 2000

[54] ELECTRONIC BALLAST WITH BOOST CONVERTER

[76] Inventor: Alejandro Cavolina, 7922 NW. 67 St., Miami, Fla. 33166

[21] Appl. No.: 09/410,827

[22] Filed: Oct. 1, 1999

[51] Int. Cl.[7] ..... H05B 37/02

[52] U.S. Cl. ..... 315/307; 315/224; 315/DIG. 7; 315/247

[58] Field of Search ..... 315/307, 224, 315/247, 291, DIG. 7

[56] References Cited

U.S. PATENT DOCUMENTS

| | | | |
|---|---|---|---|
| 5,051,662 | 9/1991 | Counts | 315/247 |
| 5,568,041 | 10/1996 | Hesterman | 323/207 |
| 5,798,615 | 8/1998 | Gasparini et al. | 315/219 |

*Primary Examiner*—David Vu

*Attorney, Agent, or Firm*—J. Sachelima

[57] ABSTRACT

An electronic ballast for gas lamp loads, such as ionized lamps, that includes a boost power factor correction used to correct the power factor and minimize the total harmonic distortion. The boost includes an inductor that periodically stores and discharges its resulting voltage in a charging capacitor through an optional bypass diode connected in parallel with an electronic switch using the oscillator that is applied to the load. The addition of the bypass diode decreases the total harmonic distortion. The inductor is selected, in combination with the rest of the circuit, so that it never reaches saturation. The inductor periodically charges the charging capacitor above (twice) the peak voltage that is supplied by a rectified continuous source of direct voltage. The high intensity discharge load is connected to a suitable resonant circuit. The load inductor as well as the elements of the resonant circuit and biasing elements of the oscillator include devices that permit a user to select different values thus affecting the resonant frequency.

9 Claims, 5 Drawing Sheets

ELECTRONIC BALLAST WITH BOOST CONVERTER

II. BACKGROUND OF THE INVENTION

1. Field of the Invention.

The present invention relates to a boost converter, and more particularly, to boost converters used with electronic ballasts for high intensity discharge lamps.

2. Description of the Related Art.

Ionized lamps, such as H.I.D. (high intensity discharge) lamps, use electronic ballasts that convert the public network's 50/60 Hz A.C. supply to a D.C. source and then through an inverter back to A.C. at a considerably higher frequency to drive the lamp. An inductor is used to limit the current through the lamp and this inductor is smaller for high frequencies. Thus, the desirability (lower weight, cost) of operating with high frequencies through the use of an electronic inverter.

Typically, the voltage of the corrector circuit is twice the input voltage which makes it necessary to use additional control circuitry requiring the use of additional active elements such as transistors and integrated circuits. The patents issued to Richard C. Counts under U.S. Pat. No. 5,051,662 and to Bryce L. Hesterman under U.S. Pat. No. 5,568,041, are such examples.

Other patents describing the closest subject matter provide for a number of more or less complicated features that fail to solve the problem in an efficient and economical way. None of these patents suggest the novel features of the present invention.

III. SUMMARY OF THE INVENTION

It is one of the main objects of the present invention to provide a corrector circuit for electronic ballasts that utilizes a minimum of components.

It is another object of this invention to provide a corrector circuit that does not require the use of active elements, such as transistors and integrated circuits.

It is still another object of the present invention to provide a corrector circuit that can withstand relatively high temperatures.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
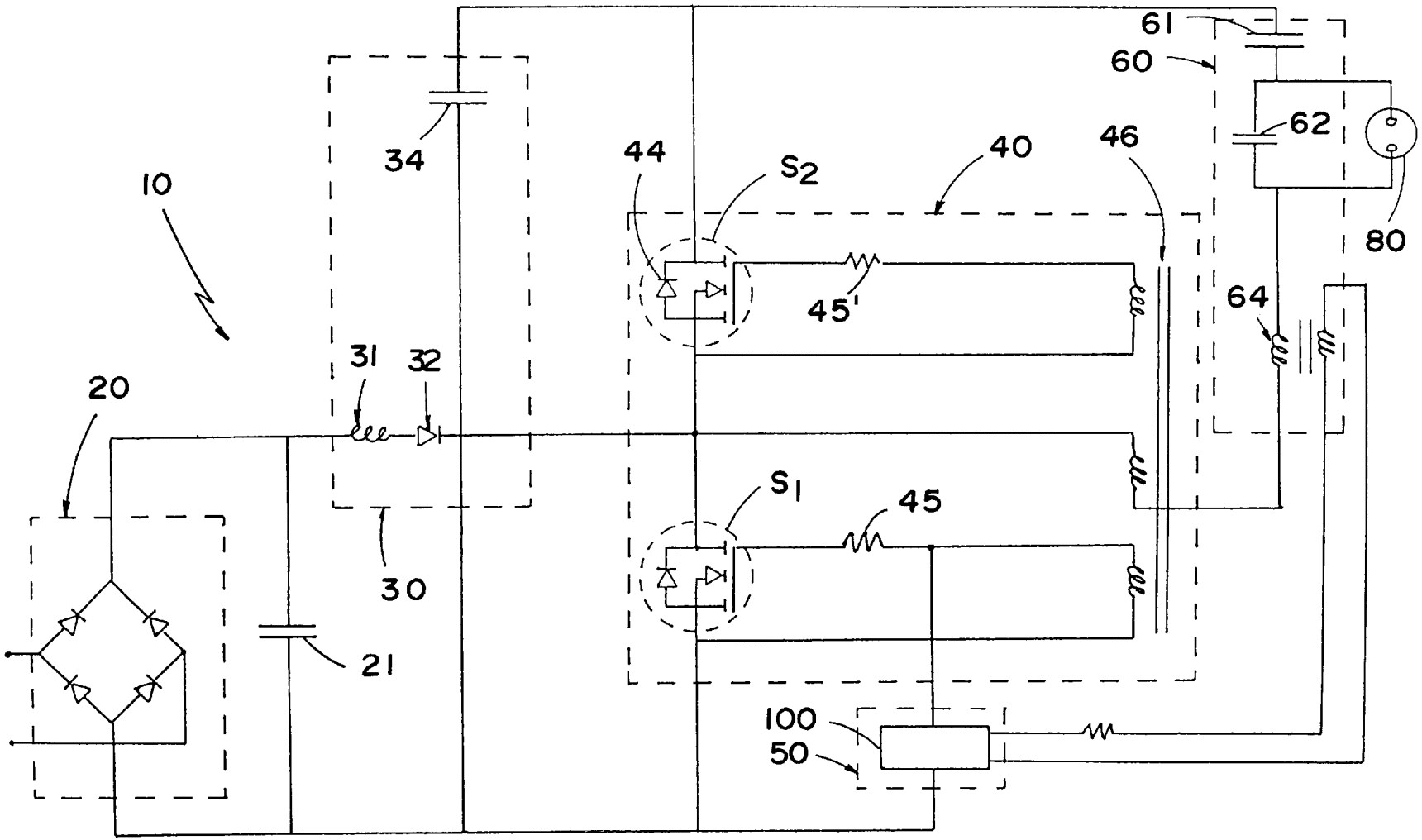
FIG. 1 represents a simplified block diagram of the electronic design used for the present invention.

Referring now to the drawings, where the present invention is generally referred to with numeral 10, it can be observed that it basically includes booster 30 that works in conjunction with oscillator circuit 40, resonant ballast circuit 60, high intensity discharge load 80 and D.C. supply circuit 20. Capacitor 21 is intended to filter out the noise of the D.C. current and voltage supply and it is optional in the present invention. Capacitor 34 is charged through inductor 31, diode 32 and freewheel diode 44 to provide a higher voltage (than without booster 30) to oscillator circuit 40.

FIG. 1 illustrates the operation of one of the preferred embodiments for the present invention in block form. Circuit 20 converts an A.C. voltage with peak value of approximately 170 volts. This D.C. voltage is applied to inductor 31 of power factor corrector (PFC) boost circuit 30 which is connected in series with diode 32 which in turn is connected to the center of oscillator circuit 40 at the common connection of electronic switches $S_1$ and $S_2$ and one end of the primary of driver transformer 46.

Figure 2:
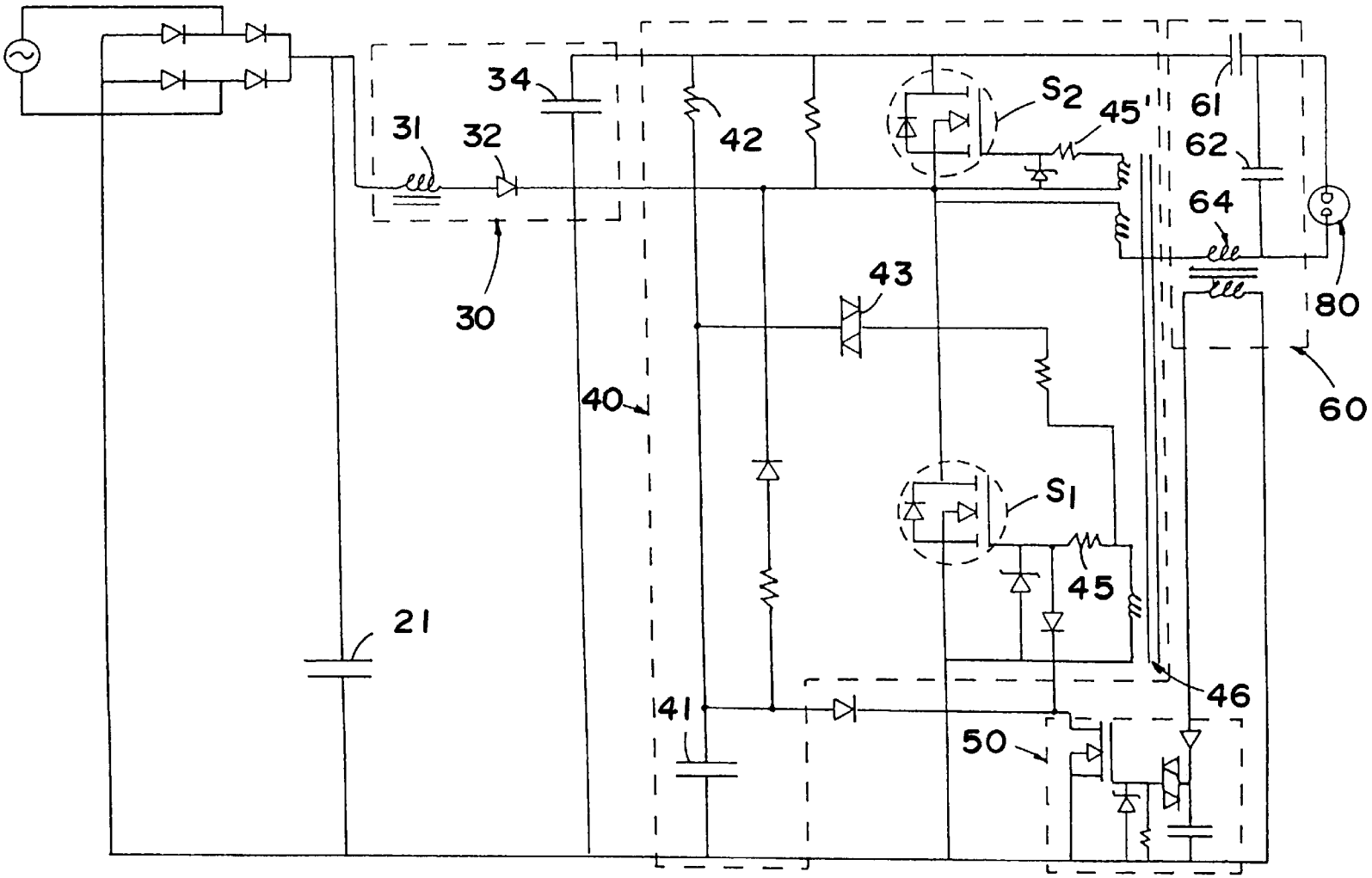
FIG. 2 shows a detailed electronic circuit for lamps HID for 120 Volts and 250 Watts built under parameters established in the present invention.

When the D.C. voltage reaches the common point of switches $S_1$ and $S_2$ (can be implemented with a power MOSFET N-channel devices such as those manufactured by Harris Semiconductors under part No. IRF 740), current flows through freewheel diode 44 and diode 32 to charge capacitor 34. Freewheel diode 44 is integrally built in part No. IRF 740. The maximum voltage capacitor 34 can achieve initially is the peak voltage of approximately 170 volts before switches $S_1$ and $S_2$ oscillate. As seen in FIG. 2, capacitor 41 charges through resistance 42 until it reaches the rated voltage of DIAC 43 which is 32 volts in the preferred embodiment. At this point, a trigger pulse is produced that causes switch $S_1$ to conduct and circuit 40 goes into oscillation. The load to circuit 40 constitutes resonant ballast circuit 60 with the high intensity discharge load 80, such as an HID lamp, in parallel with capacitor 62. Capacitor 62 and load 80 are in series with capacitor 63 and load inductor 64.

Circuit 40 is described in my prior U.S. Pat. No. 5,798,615 including one of the preferred implementations for driver transformer 46. Also, the application note of International Rectifier Co. is referred to in my patent.

Figure 8:
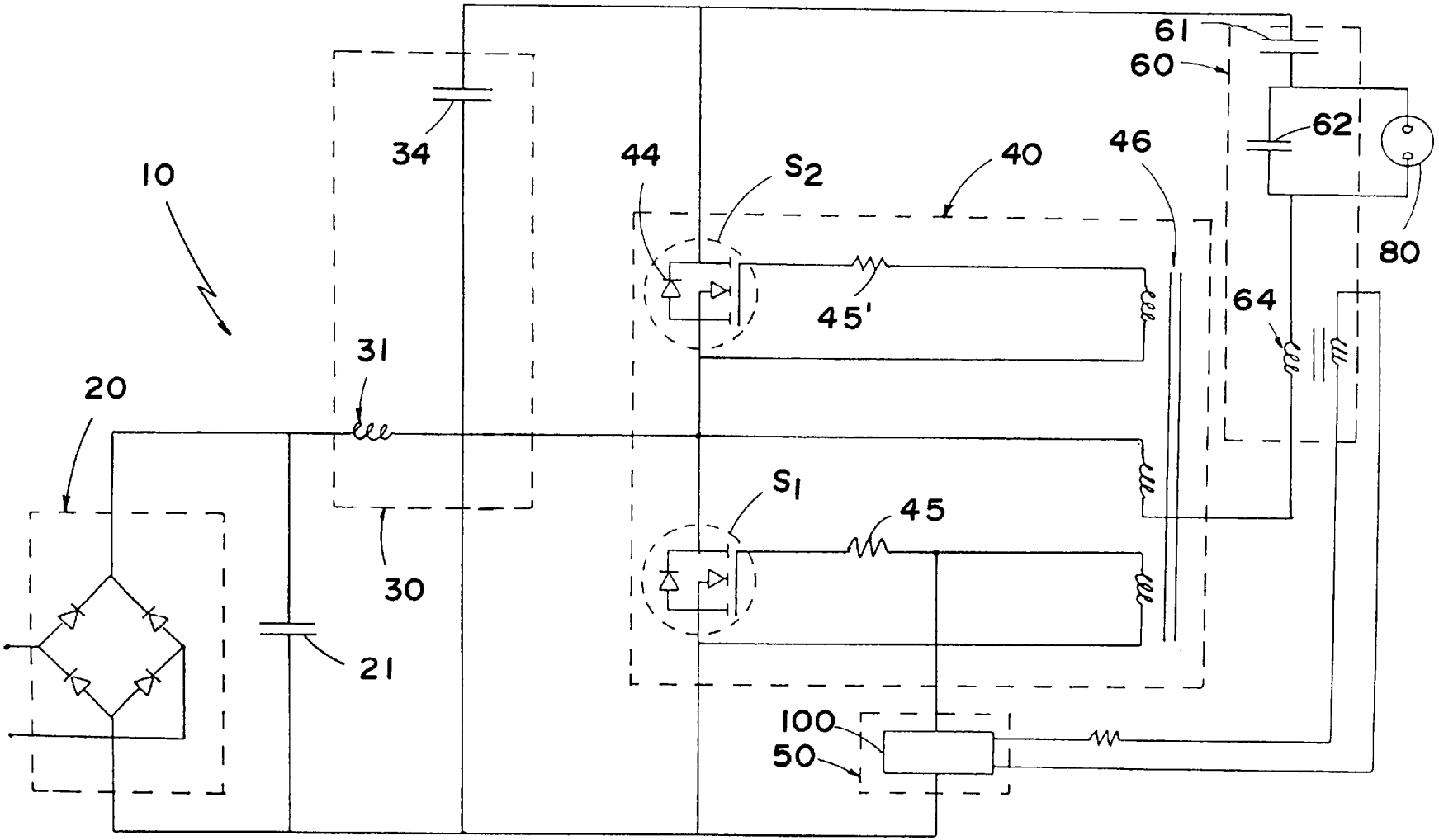
FIG. 8 is another embodiment similar to FIG. 1 with the booster's diode removed.

Once circuit 40 goes into oscillation, switch $S_1$ delivers a high frequency voltage to circuit 60 and load 80 but it is also used to charge inductor 31. Switch $S_1$ closes and draws current from circuit 60 and load 80 and also independently draws current from inductor 31 thus charging the latter. But is clear that the current drawn from inductor 31 does not affect the current through driver transformer 46. Therefore, the current passing through inductor 31 does not affect the operating frequency. The charge time for inductor 31 should never be exceeded. The charge time for inductor 31 is the time over which a constant voltage is applied and the inductor does not behave strictly as a resistive element (prior to saturation) and the current is still increasing. Inductor 31 is selected so that its charge time is greater than one half the period of the operating frequency of oscillator circuit 40. Otherwise, the current that would be drawn from circuit 20 may be excessive. Once switch $S_1$ opens, no more current goes through inductor 31 developing a large back voltage proportional to its inductance and the change of current intensity (V=L dI/dt). The resulting relatively large voltage passes (in a few nanoseconds) through diodes 32 and 44 to charge capacitor 34. The MOSFETs have a non-instant falling edge. If it is too fast, the voltage could be too high burning the components. In this manner, capacitor 34 can be charged to voltages above those permitted by the relatively low rectified AC line (170 peak approximately) and simultaneously correct the power factor (above 0.97) while keeping the total harmonic distortion (THD) below 10%. This is achieved with a minimum of non-active and reliable components. Furthermore, even if diode 32 is not used, the only effect would be a relatively small increase in THD (approx. 10%) but the circuit still works. See FIG. 8 where diode 32 has been eliminated from FIG. 1.

Figure 3:
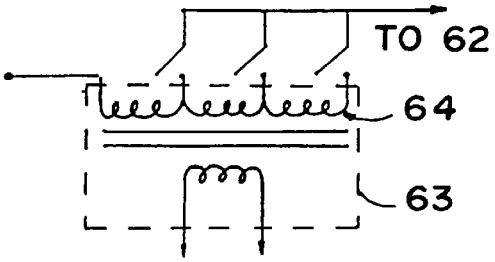
FIG. 3 illustrates a partial electronic circuit showing load inductor with multiple outputs.
Figure 4:
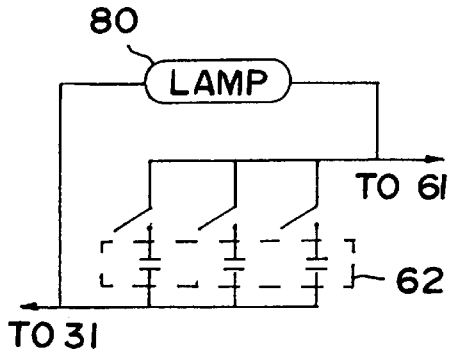
FIG. 4 is a representation of a partial electronic circuit showing a capacitance bank for the present invention.
Figure 5:
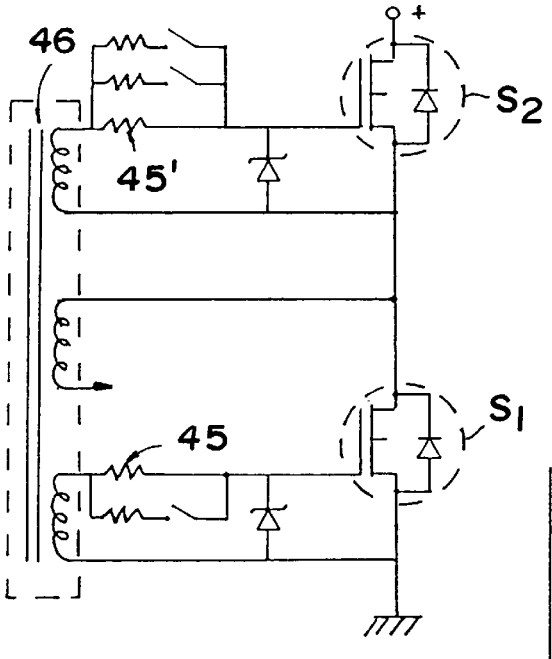
FIG. 5 represents a partial electronic circuit showing a driver with multiple resistors for transistors ignition.
Figure 6:
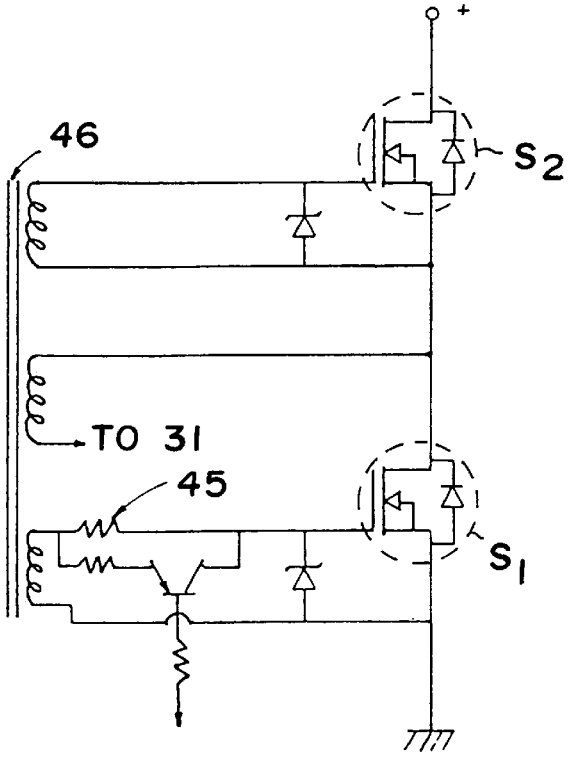
FIG. 6 is a partial electronic circuit showing a driver with closed loop for power control.

In some applications it may be desirable to vary the power output by varying the frequency. This can be readily accomplished by using different taps for inductor 64, varying the capacitance of capacitor 62 and/or varying the values of resistances 45 and 45'. These possibilities are shown in FIGS. 3; 4; 5 and 6. Protection circuitry 100 shorts out the gate of switch $S_1$, disabling it, when the voltage in inductor 64 exceeds a predetermined magnitude.

Figure 7:
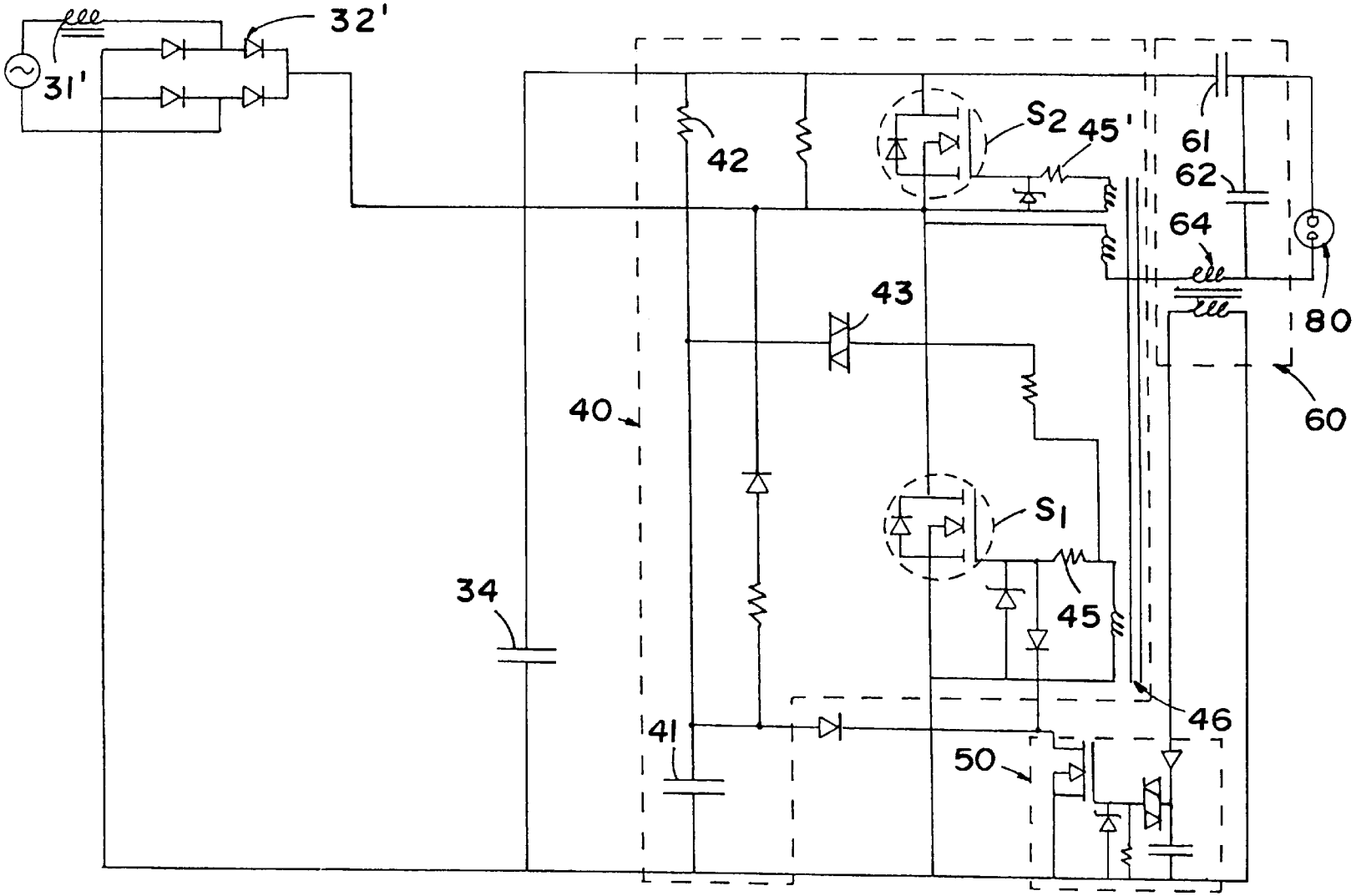
FIG. 7 is a schematic representation of an alternate embodiment using one of the diodes of the rectifier bridge in conjunction with the booster's inductor.

An alternate embodiment for the circuit is shown in FIG. 7 wherein inductor 31' has been moved before diode 32' of the rectifier bridge. It has been found that the same results are obtained when diode 32' replaces diode 32 in FIG. 1 thereby saving one component.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An electronic ballast for a high intensity discharge load, comprising:

A) electricity source means for delivering a direct voltage including positive and negative outputs;

B) inductive means having two contacts and one of said contacts being connected to said positive output;

C) a diode having P and N elements with said P element connected to the other contact of said inductive means;

D) oscillator means adapted to provide an oscillating signal and said oscillator means includes first and second electronic switching means each having drain and source connections, said first and second electronic switching means having a common connection point with a source of said first switching means connected to the drain of said second switching means, said common connection being connected to said N element and the source of said second switching means being connected to said negative output, and said first electronic switching means further including a freewheel diode connected in series;

E) a charging capacitor adapted to apply a periodic voltage and said charging capacitor being connected between the drain of said first switching means and the source of said second switching means so that the voltage stored in said inductive means is periodically transferred to said charging capacitor through said freewheel diode resulting in a voltage applied to said common connection that is higher than the peak voltage provided by said electricity source means; and F) means for providing a resonant frequency to said oscillator means including a gas lamp load and said means for providing a resonant frequency being connected across said first and second switching means.

2. The electronic ballast set forth in claim 1 wherein said first and second electronic switching means include biasing means that can be selectively adjusted to provide predetermined resonant frequencies.

3. The electronic ballast set forth in claim 2 wherein said means for providing a resonant frequency includes a load inductor in series with a first capacitor and also in series with a second capacitor that in turn is in parallel with said high intensity load, and said second capacitor including means for selectively changing its capacitance.

4. An electronic ballast for a high intensity discharge load, comprising:

A) electricity source means for delivering an alternating voltage including first and second outputs;

B) inductive means having two contacts and one of said contacts being connected to said first output;

C) a rectifier bridge assembly including first, second, third and fourth diodes each having P and N elements and said first diode's P element connected to the other contact of said inductive means, said rectifier assembly further including a positive output connected to the N element of said first diode;

D) oscillator means adapted to provide an oscillating signal and said oscillator means includes first and second electronic switching means each having drain and source connections, said first and second electronic switching means having a common connection point with a source of said first switching means connected to the drain of said second switching means, said common connection being connected to said N element of said first diode, and said first electronic switching means further including a freewheel diode connected in series;

E) a charging capacitor adapted to apply a periodic voltage and said charging capacitor being connected between the drain of said first switching means and the source of said second switching means so that the voltage stored in said inductive means is periodically transferred to said charging capacitor through said treewheel diode resulting in a voltage applied to said common connection that is higher than the peak voltage provided by said electricity source means; and F) means for providing a resonant frequency to said oscillator means including a gas lamp load and said means for providing a resonant frequency being connected across said fist and second switching means.

5. The electronic ballast set forth in claim 4 wherein said first and second electronic switching means include biasing means that can be selectively adjusted to provide predetermined resonant frequencies.

6. The electronic ballast set forth in claim 5 wherein said means for providing a resonant frequency includes a load inductor in series with a first capacitor and also in series with a second capacitor that in turn is in parallel with said high intensity load, and said second capacitor including means for selectively changing its capacitance.

7. An electronic ballast for a high intensity discharge load, comprising:

A) electricity source means for delivering a direct voltage including positive and negative outputs;

B) inductive means having two contacts and one of said contacts being connected to said positive output;

C) oscillator means adapted to provide an oscillating signal and said oscillator means includes first and second electronic switching means each having drain and source connections, said first and second electronic switching means having a common connection point with a source of said first switching means connected to the drain of said second switching means, said common connection being connected to the other contact of said inductive means and the source of said second switching means being connected to said negative output, and said first electronic switching means further including a freewheel diode connected in series;

D) a charging capacitor adapted to apply a periodic voltage and said charging capacitor being connected between the drain of said first switching means and the source of said second switching means so that the voltage stored in said inductive means is periodically transferred to said charging capacitor through said treewheel diode resulting in a voltage applied to said common connection that is higher than the peak voltage provided by said electricity source means; and E) means for providing a resonant frequency to said oscillator means including a gas lamp load and said means for providing a resonant frequency being connected across said first and second switching means.

8. The electronic ballast set forth in claim 7 wherein said first and second electronic switching means include biasing means that can be selectively adjusted to provide predetermined resonant frequencies.

9. The electronic ballast set forth in claim 8 wherein said means for providing a resonant frequency includes a load inductor in series with a first capacitor and also in series with a second capacitor that in turn is in parallel with said high intensity load, and said second capacitor including means for selectively changing its capacitance.

* * * * *